US008750734B2

(12) United States Patent
Fukao

(10) Patent No.: US 8,750,734 B2
(45) Date of Patent: Jun. 10, 2014

(54) TRANSFER DEVICE AND IMAGE FORMING APPARATUS INCLUDING SAME

(75) Inventor: Takeshi Fukao, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 144 days.

(21) Appl. No.: 13/348,313

(22) Filed: Jan. 11, 2012

(65) Prior Publication Data

US 2012/0189332 A1 Jul. 26, 2012

(30) Foreign Application Priority Data

Jan. 26, 2011 (JP) ..... 2011-014169

(51) Int. Cl.
*G03G 15/00* (2006.01)

(52) U.S. Cl.
USPC ..... 399/49

(58) Field of Classification Search
USPC ..... 399/49, 313
See application file for complete search history.

(56) References Cited

U.S. PATENT DOCUMENTS

| | | | |
|---|---|---|---|
| 6,445,900 | B2 | 9/2002 | Fukao et al. |
| 6,868,248 | B2 | 3/2005 | Fukao et al. |
| 7,383,001 | B2 | 6/2008 | Fukao |
| 7,499,665 | B2 | 3/2009 | Kuma et al. |
| 7,509,073 | B2 | 3/2009 | Katoh et al. |
| 7,609,998 | B2 | 10/2009 | Katoh et al. |
| 7,627,268 | B2 | 12/2009 | Katoh et al. |
| 7,848,692 | B2 | 12/2010 | Saeki et al. |
| 7,885,588 | B2 | 2/2011 | Katoh et al. |
| 7,899,386 | B2 | 3/2011 | Saeki et al. |
| 7,933,546 | B2 | 4/2011 | Fukao et al. |
| 2004/0013451 | A1 | 1/2004 | Fukao et al. |
| 2006/0210307 | A1 | 9/2006 | Katoh et al. |
| 2006/0210324 | A1 | 9/2006 | Kuma et al. |
| 2006/0216057 | A1 | 9/2006 | Fukao |
| 2006/0284958 | A1 | 12/2006 | Saeki et al. |
| 2007/0098472 | A1 | 5/2007 | Saeki et al. |

(Continued)

FOREIGN PATENT DOCUMENTS

| | | | |
|---|---|---|---|
| JP | 05323704 | A | 12/1993 |
| JP | 2005078050 | A | 3/2005 |

(Continued)

OTHER PUBLICATIONS

Abstract of JP 2005-078050 published Mar. 24, 2005.

(Continued)

*Primary Examiner* — Hoang Ngo
(74) *Attorney, Agent, or Firm* — Harness, Dickey & Pierce, P.L.C.

(57) ABSTRACT

A transfer device includes an image bearing member, a transfer member, a test image detector, and a shield member. The image bearing member bears a toner image on a surface thereof within an image forming area. The transfer member disposed opposite the image bearing member forms a transfer nip between the transfer member and the image bearing member through which the recording medium is conveyed and transfers the toner image from the image bearing member onto the recording medium in the transfer nip. The test image detector disposed downstream from the transfer nip in the direction of conveyance of the recording medium detects a density of a test image for adjustment of toner density formed outside the image forming area. The shield member disposed between the test image and the transfer member shields the test image from an electrical field generated between the image bearing member and the transfer member.

17 Claims, 4 Drawing Sheets

(56) References Cited

U.S. PATENT DOCUMENTS

| | | | | |
|---|---|---|---|---|
| 2007/0127947 | A1 | 6/2007 | Kuma et al. | |
| 2007/0127955 | A1 | 6/2007 | Katoh et al. | |
| 2007/0242965 | A1 * | 10/2007 | Akamatsu | 399/49 |
| 2007/0248391 | A1 | 10/2007 | Yokokawa et al. | |
| 2007/0286640 | A1 | 12/2007 | Katoh et al. | |
| 2008/0145102 | A1 | 6/2008 | Katoh et al. | |
| 2008/0175619 | A1 | 7/2008 | Katoh et al. | |
| 2009/0169236 | A1 | 7/2009 | Fukao et al. | |
| 2009/0279906 | A1 | 11/2009 | Kuma et al. | |
| 2009/0317104 | A1 | 12/2009 | Katoh et al. | |
| 2010/0061752 | A1 | 3/2010 | Sudo et al. | |
| 2011/0103862 | A1 | 5/2011 | Saeki et al. | |

FOREIGN PATENT DOCUMENTS

| | | | |
|---|---|---|---|
| JP | 2006194963 | A | 7/2006 |
| JP | 2008-145827 | * | 6/2008 |
| JP | 2008145827 | A | 6/2008 |
| JP | 2007192912 | A | 8/2009 |
| JP | 2010197722 | A | 9/2010 |

OTHER PUBLICATIONS

Abstract of JP 2009-192912 published Aug. 27, 2009.
Abstract of JP 05-323704 published Dec. 7, 1993.
Abstract of JP 2010-197722 published Sep. 9, 2010.
Abstract of JP 2008-145827 published Jun. 26, 2008.
Abstract of JP 2006-194963 published Jul. 27, 2006.

* cited by examiner

TRANSFER DEVICE AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2011-014169, filed on Jan. 26, 2011 in the Japanese Patent Office, the entire disclosure of which is hereby incorporated by reference herein.

BACKGROUND OF THE INVENTION

1. Field of the Invention

Exemplary aspects of the present invention generally relate to a transfer device and an image forming apparatus including the transfer device, and more particularly, to a transfer device including a toner scatter prevention mechanism and an image forming apparatus including the transfer device.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; a transfer device transfers the toner image directly from the image bearing member onto a recording medium or indirectly from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In a known color image forming apparatus, a plurality of imaging forming stations, one for each of the colors, for example, cyan, magenta, yellow, and black, are disposed around a drum-type intermediate transfer member or disposed in tandem along a belt-type intermediate transfer member. Toner images formed in the image forming stations are primarily transferred onto the intermediate transfer member so that they are superimposed one atop the other, thereby forming a composite toner image on the surface of the intermediate transfer member. Subsequently, the composite toner image is transferred secondarily onto a recording medium, such as a sheet of paper.

When forming a color image, a toner density of the toner image needs to be adjusted to obtain a desired image quality. In the case of the belt-type intermediate transfer member (hereinafter referred to as an intermediate transfer belt), in order to achieve a desired toner density of developed images, a test image, also known as a pattern image, is formed on the intermediate transfer belt, and the toner density of the test image is detected by an optical detector, and the toner density of the image to be produced is then adjusted to the desired toner density by changing image forming conditions, which include charging properties, writing properties, a developing bias, and a density of the developing agent.

Generally, the test images are different from an actual image to be output on a recording medium. Thus, the test images are formed at specific times, such as between successive recording media sheets when recording media sheets are continuously fed, such as during continuous imaging operations. Furthermore, the test images are formed on the intermediate transfer belt in a manner similar to that of the actual image forming operation when the image forming operation for forming the actual image does not take place.

After the composite toner image is formed on the intermediate transfer belt in a primary transfer process, the composite toner image is transferred onto the recording medium in a secondary transfer process. In order to increase the efficiency of the secondary transfer, typically a transfer bias is supplied to a back tension roller disposed at the back of the intermediate transfer belt, opposite a secondary transfer member.

In this approach, a repulsive force acts on toner on the intermediate transfer belt to facilitate transfer of toner. More specifically, an electrostatic force from the back tension roller acts on the toner, thereby repelling the toner and hence facilitating transfer of the toner from the intermediate transfer belt to the recording medium.

However, there is a drawback to such a configuration in that the repulsive force acts also on the test images, causing the toner in the test images on the intermediate transfer belt to scatter directly toward the secondary transfer member. As a result, the scattered toner may contaminate the optical detector described above, disposed near the belt surface, that is, at the secondary transfer member side, resulting in detection failure. Furthermore, the scattered toner may stick to various components such as a sheet guide for guiding the recording medium from the secondary transfer portion and a charge eliminator for separating the recording medium from the intermediate transfer belt, resulting in contamination of the recording medium and poor separation of the recording medium from the intermediate transfer member.

To counteract this problem, a known approach to prevent contamination with the scattered toner due to the repulsive force employs a shield to cover the place where the test image is formed between successive recording media sheets being transported. The shield is then removed during image transfer.

In a case in which the test image is formed within an image forming area on the intermediate transfer belt, the shield is provided between the test image and the charge eliminator to prevent the test image formed on the intermediate transfer belt from being affected by electrical discharge from the charge eliminator. Upon transfer of the actual image, the shield is opened, allowing the electrical discharge from the charge eliminator to reach the recording medium so that the recording medium is separated from the intermediate transfer belt.

Although advantageous, a dedicated structure for opening and closing the shield is necessitated, increasing the size of the transfer device as a whole. Furthermore, a complicated control system for controlling the timing with which the shield is opened and closed is required, because the opening and closing of the shield needs to be synchronized with arrival of the test image or the actual image at the charge eliminator.

In another approach, an electrically conductive member is disposed opposite the intermediate transfer belt and connected to ground to collect the charged toner scattered from the intermediate transfer belt electrostatically. The conductive member serving as a dust collecting member, the conductive member is disposed downstream from a secondary transfer position to attract electrostatically the toner on the intermediate transfer belt.

In this configuration, however, because the detection position for the density of the test image is further back from the dust collecting position, some toner in the test image may be collected undesirably by the dust collecting member, affecting the accuracy of image density readings obtained by the optical detector.

BRIEF SUMMARY

In view of the foregoing, in an aspect of this disclosure, a transfer device includes an image bearing member, a transfer member, a test image detector, and a shield member. The image bearing member bears a toner image on a surface thereof within a predetermined image forming area. The transfer member is disposed opposite the image bearing member to form a transfer nip between the transfer member and the image bearing member through which the recording medium is conveyed and to transfer the toner image from the image bearing member onto the recording medium in the transfer nip. The test image detector is disposed downstream from the transfer nip in the direction of conveyance of the recording medium to detect a density of a test image for adjustment of toner density formed outside the image forming area of the image bearing member. The shield member is disposed between the test image and the transfer member to shield the test image from an electrical field generated between the image bearing member and the transfer member.

According to another aspect, an image forming apparatus includes an image bearing member, a developing device, and a transfer device. The image bearing member bears a latent image on a surface thereof within an image forming area. The developing device develops the latent image on the image bearing member with toner to form a toner image. The transfer device transfers the toner image on the image bearing member to a recording medium. The transfer device includes a transfer member, a test image detector, and a shield member. The transfer member is disposed opposite the image bearing member to form a transfer nip between the transfer member and the image bearing member through which the recording medium is conveyed and to transfer the toner image from the image bearing member onto the recording medium in the transfer nip. The test image detector is disposed downstream from the transfer nip in the direction of conveyance of the recording medium to detect a density of a test image for adjustment of the density of the toner image formed outside the image forming area of the image bearing member. The shield member is disposed between the test image and the transfer member to shield the test image from an electrical field generated between the image bearing member and the transfer member.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
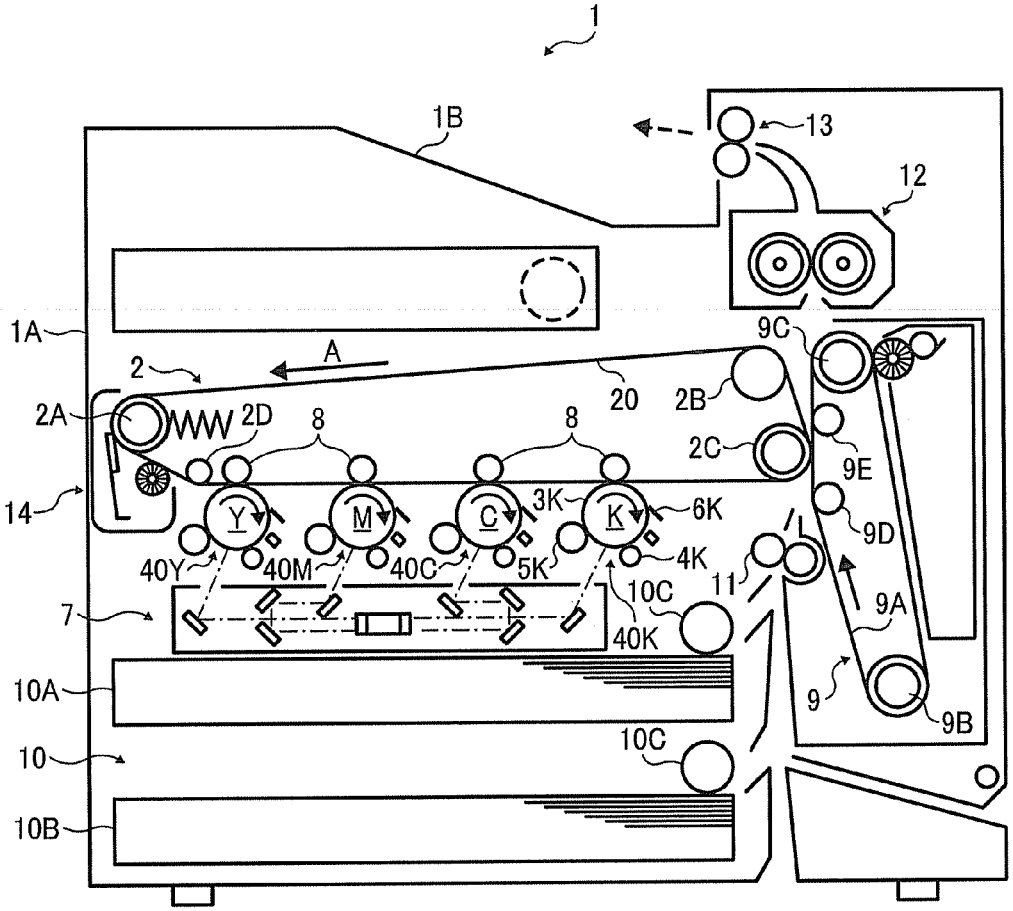
FIG. 1 is a schematic diagram illustrating an image forming apparatus employing a transfer device according to an illustrative embodiment of the present invention.

A description is now given of illustrative embodiments of the present application. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially with reference to FIG. 1, a description is provided of an image forming apparatus according to an aspect of the disclosure.

As illustrated in FIG. 1, the image forming apparatus 1 includes a housing 1A. Within the housing 1A, the image forming apparatus 1 includes a primary transfer device 2 including a transfer belt 20, a secondary transfer device 9, a sheet feed unit 10, a developing device 12, and so forth. The image forming apparatus 1 is a tandem-type color printer including four image forming units 40Y, 40M, 40C, and 40K disposed in tandem along the transfer belt 20 serving as an intermediate transfer body.

In the housing 1A, the primary transfer device 2 is disposed substantially at the center thereof in a vertical direction. The primary transfer device 2 is equipped with the transfer belt 20. The transfer belt 20 is formed into a loop and wound around a plurality of rollers. The image forming units 40Y, 40M, 40C, and 40K, one for each of the colors yellow (Y), magenta (M), cyan (C), and black (K) are disposed (not necessarily in that order) in tandem facing the transfer belt 20 of the primary transfer device 2. It is to be noted that the suffixes Y, M, C, and K denote colors yellow, magenta, cyan, and black, respectively.

As noted above, the transfer belt 20 is wound around a plurality of rollers: 2A, 2B, 2C, and 2D. The transfer belt 20 has a multilayer structure including a base layer and a surface layer disposed on the base layer. The base layer of the transfer belt 20 includes a stretch-resistant resin material such as fluorocarbon resin and a polyvinylidene fluoride sheet, or polyimide resin. The surface layer disposed on the base layer includes resin material such as fluorocarbon resin providing a smooth surface.

The image forming units 40Y, 40M, 40C, and 40K all have the same configuration as all the others, differing only in the color of toner employed. Thus, the following description is of the image forming unit 40K as a representative example of the image forming units.

As illustrated in FIG. 1, the image forming unit 40K includes a photoconductive drum 3K surrounded by various pieces of imaging equipment such as a charging device 4K, a developing device 5K, and a cleaning device 6K disposed in that order in the direction of rotation of the photoconductive drum 3K indicated by an arrow. The photoconductive drum 3K is disposed outside the loop formed by the transfer belt 20 and rotates clockwise while contacting the transfer belt 20. A transfer roller 8 is disposed inside the loop of the transfer belt 20 and contacts the photoconductive drum 3K via the transfer belt 20.

The image forming apparatus 1 includes an optical writing unit 7 disposed substantially below the image forming units 40. The charging device 4K charges the surface of the photoconductive drum 3K at a certain electric potential. The optical writing unit 7 illuminates the charged surface of the photoconductive drum 3K with light based on image information, thereby forming an electrostatic latent image on the surface of the photoconductive drum 3K. The developing device 4K develops the electrostatic latent image on the surface of photoconductive drum 3K with toner, thereby forming a visible image, also known as a toner image. The toner image on the photoconductive drum 3K is transferred onto the transfer belt 20 when the toner image on the photoconductive drum 3K comes to a position opposite the transfer roller 8 via the transfer belt 20. Similar to the image forming unit 40K, this transfer process is performed in other image forming units 40. The toner images formed in the image forming units 40 are transferred onto the transfer belt 20 so that they are superimposed one atop the other, thereby forming a composite toner image on the transfer belt 20.

Subsequently, in the secondary transfer device 9 disposed near the transfer belt 20, the composite toner image on the transfer belt 20 is transferred onto a recording medium P supplied from the sheet feed unit 10.

The secondary transfer device 9 includes a belt-type secondary transfer member 9A (hereinafter, a secondary transfer belt) wound around a plurality of rollers 9B, 9C, 9D, and 9E, and formed into a loop. The secondary transfer belt 9A is electrically insulating and capable of absorbing and carrying the recording medium thereon.

The sheet feed unit 10 is equipped with sheet cassettes 10A and 10B accommodating a stack of recording media sheets. Each of the sheet cassettes 10A and 10B is provided with a pickup roller 10C. The pick up roller 10C picks up a top sheet from the stack of recording media sheets in the sheet cassette and feeds it to a pair of registration rollers 11 in appropriate timing such that the recording medium P is aligned with the composite toner image formed on the transfer belt 20. While the recording medium P is absorbed and carried on the secondary transfer belt 9A, the composite toner image on the transfer belt 20 is transferred onto the recording medium P.

In the secondary transfer device 9, the rollers 9D and 9E are disposed inside the loop formed by the secondary transfer belt 9A, opposite the transfer belt 20. The rollers 9D and 9E serve as bias rollers for absorbing the recording medium P onto the secondary transfer belt 9A and for transfer of the toner image. The portion of the secondary transfer belt 9A spanned between the rollers 9D and 9E is a transfer area at which the composite toner image on the transfer belt 20 is transferred onto the recording medium P. A tension roller 2C is disposed inside the loop formed by the transfer belt 20, opposite the transfer area of the secondary transfer belt 9A. As will be described later, the tension roller 2C serves also as a repulsive force application member to apply a repulsive force to the toner borne on the transfer belt 20.

The recording medium P onto which the composite toner image is transferred from the transfer belt 20 by the secondary transfer device 9 is interposed between the transfer belt 20 and the secondary transfer belt 9A, and conveyed to a fixing device 12. The fixing device 12 is disposed downstream from the secondary transfer device 9 in the direction of sheet conveyance. In the fixing device 12, heat and pressure are applied to the recording medium P so that the composite toner image on the recording medium P is fixed thereon. Subsequently, the recording medium P is discharged onto a sheet discharge tray 1B disposed at the upper portion of the image forming apparatus 1 by a sheet discharge roller 13.

After the composite toner image is transferred onto the recording medium P by the secondary transfer device 9, residual toner not having been transferred and hence remaining on the transfer belt 20 of the primary transfer device 2 is cleaned by a belt cleaner 14 in preparation for the subsequent imaging cycle. In the image forming units 40, the photoconductive drums 3 are cleaned by cleaning devices. The secondary transfer belt 9A in the secondary transfer device 9 is also cleaned to remove foreign substance such as a corona product and paper dust after transfer.

Figure 2:
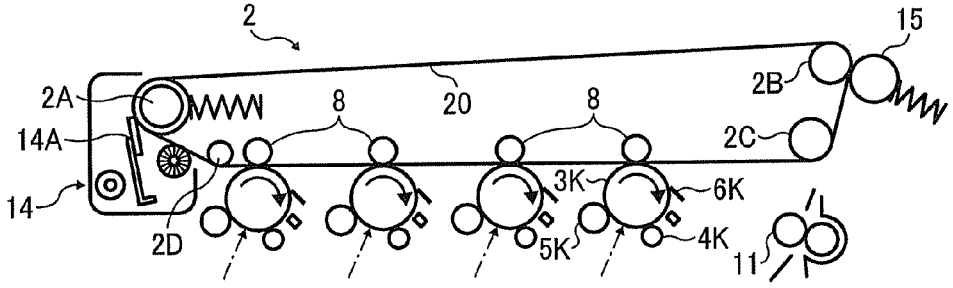
FIG. 2 is a schematic diagram illustrating a variation of the transfer device shown in FIG. 1.

With reference to FIG. 2, a description is provided of a variation of the secondary transfer device. FIG. 2 is a schematic diagram illustrating the secondary transfer device using a roller-type secondary transfer member 15 (hereinafter referred to as a secondary transfer roller), instead of the belt-type secondary transfer member 9A. In this configuration, the secondary transfer roller 15 contacts, via the transfer belt 20, a back tension roller 2B around which a portion of the transfer belt 20 is wound, thereby fowling a transfer nip therebetween. The back tension roller 2B presses the transfer belt 20 from inside the loop formed by the transfer belt 20.

Figure 3:
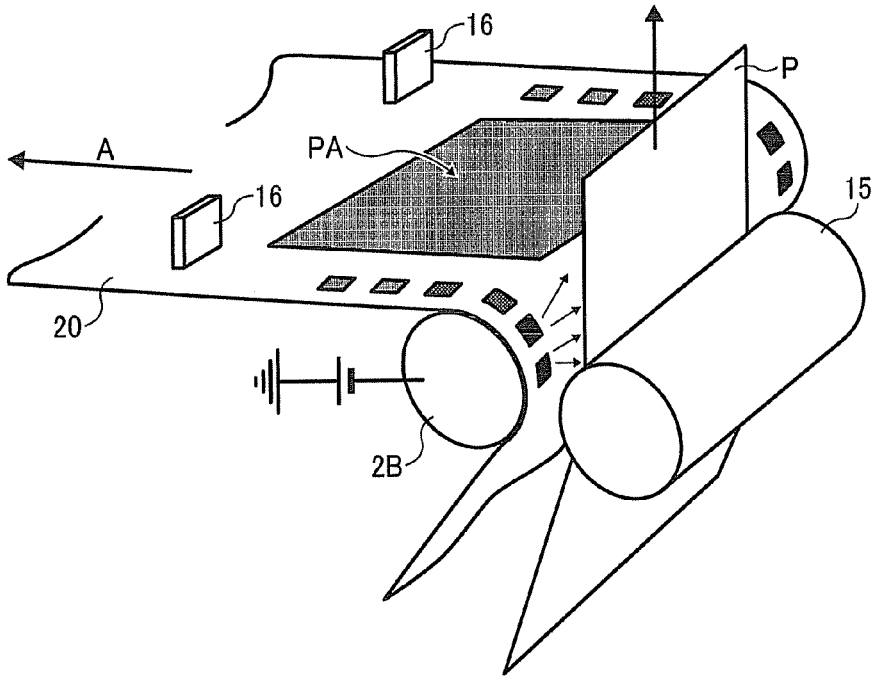
FIG. 3 RELATED ART
FIG. 3 is a perspective view schematically illustrating a related-art transfer device.
Figure 4:
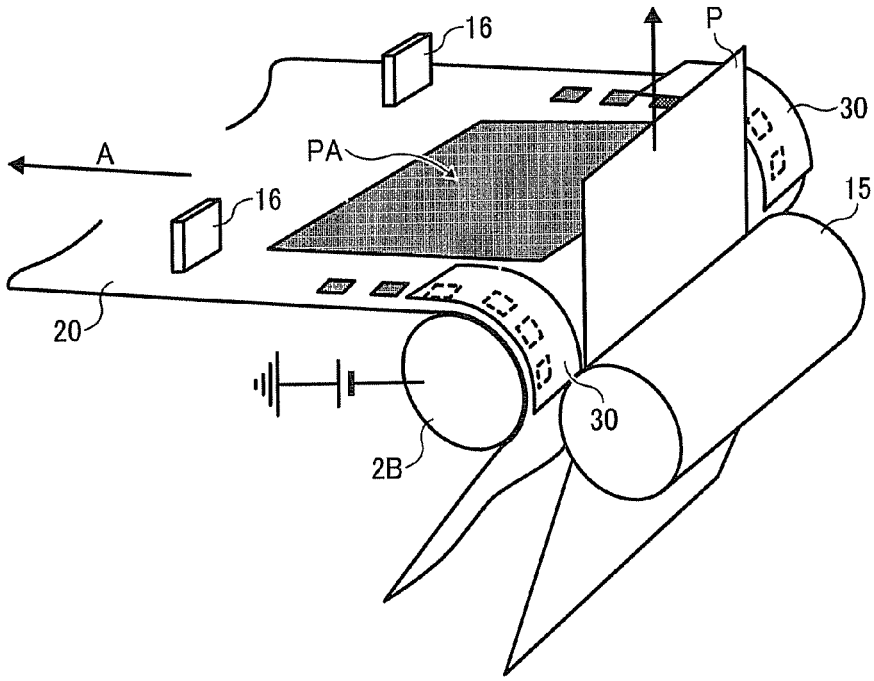
FIG. 4 is a perspective view schematically illustrating the transfer device including a shield member to protect a test image from an electrical field according to an illustrative embodiment.

With reference to FIGS. 3 and 4, a description is provided of a test image formed on the transfer belt 20 for adjustment of an image density. FIG. 3 is a perspective view schematically illustrating a related-art transfer device. FIG. 4 is a perspective view schematically illustrating the transfer device according to an illustrative embodiment.

According to the illustrative embodiment, the test image for adjustment of image density is formed on the transfer belt 20 outside an image forming area indicated by reference letters "PA" of the transfer belt 20 serving as an image bearing member. In the present embodiment, the test images are formed on the sides of the belt, between the edges of the belt and the central image forming area. At a secondary transfer position at which the transfer belt 20 is interposed between the secondary transfer roller 15 and the back tension roller 2B, a shield member 30 is provided to prevent toner in the test image from scattering toward the secondary transfer roller side.

With reference to FIG. 3, a description is provided of the related-art transfer device. In FIG. 3, a plurality of test images is formed outside the image forming area "PA" in a width direction in FIG. 3. Here, the width direction corresponds to a direction perpendicular to the direction of rotation of the transfer belt 20 indicated by an arrow A. The plurality of test images is formed along the direction of rotation of the transfer belt 20. The test images are formed to have different toner density and are detected by a density detector 16 disposed downstream from a secondary transfer nip (a secondary transfer position) between the transfer belt 20 and the secondary transfer roller 15 in the direction of arrow A.

In order to increase transfer efficiency of toner borne on the transfer belt 20, a bias that exerts a repulsive force on the toner is supplied to the back tension roller 2B disposed opposite the secondary transfer roller 15 to facilitate toner transfer. Accordingly, the composite toner image on the transfer belt 20 can move easily from the surface of the transfer belt 20 to the recording medium P.

Although advantageous, the repulsive force acts also on the test images formed outside the image forming area "PA" of the transfer belt 20, causing some toner in the test images to scatter towards the secondary transfer roller side as indicated by arrows in FIG. 3. As a result, the density of test images detected after the toner images pass through the secondary transfer nip, that is, the position opposite the secondary transfer roller 15, is different from the actual toner density, degrading the detection accuracy. Furthermore, the scattered toner may adhere to devices near the secondary transfer roller 15, resulting in contamination of the recording medium P and the peripheral devices.

Figure 5:
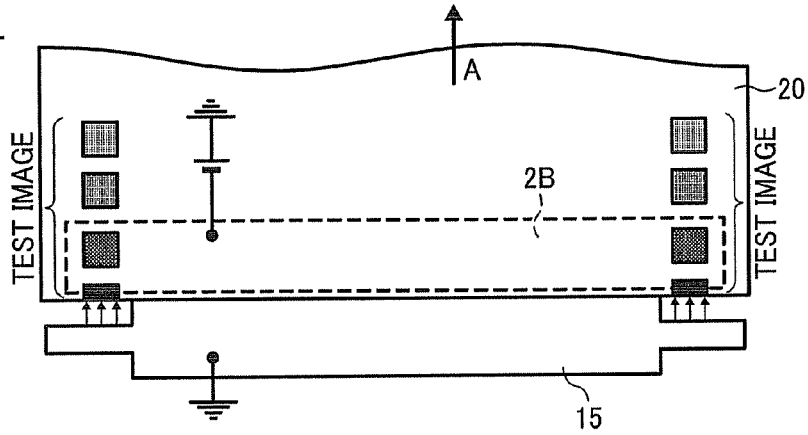
FIG. 5 RELATED ART
FIG. 5 is a plan view schematically illustrating the related-art transfer device of FIG. 3.
Figure 6:
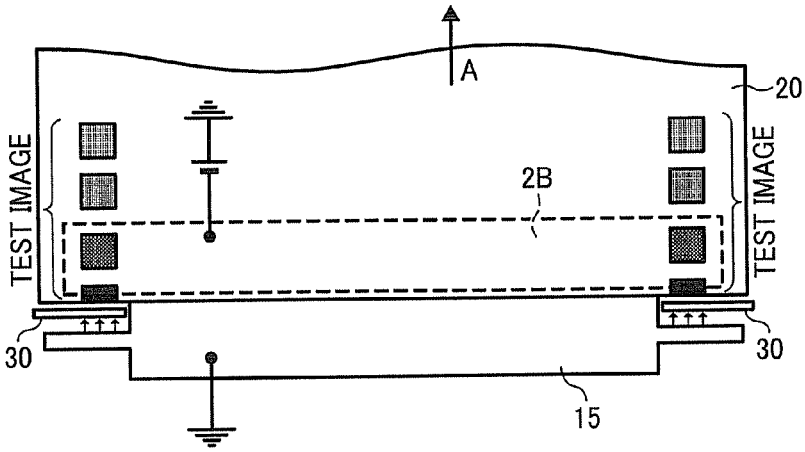
FIG. 6 is a plan view schematically illustrating the transfer device of FIG. 4.

FIG. 5 is a plan view schematically illustrating the secondary roller 15, the transfer belt 20, and the test images shown in FIG. 3. FIG. 6 is a plan view schematically illustrating the secondary roller 15, the transfer belt 20, the test images, and the shield member 30 shown in FIG. 4.

As illustrated in FIG. 4, the shield member 30 is disposed outside the image forming area PA between the secondary transfer roller 15 and the transfer belt 20 opposite the back tension roller 2B, to protect the test images from the electric field generated by the bias. More specifically, the shield member 30 is disposed over the place corresponding to where the test images are formed.

The shield member 30 is a planar member made of electrically insulating, non-conductive resin. The shield member 30 includes a curved portion and a flat plane continuous with the curved portion. The curved portion covers the outer circumferential surface of the back tension roller 2B. The flat plane of the shield member 30 extends continuously from the curved portion and parallel to the stretched surface of the transfer belt 20.

With this configuration, the shield member 30 blocks the electrical field generated between the secondary transfer roller 15 and the back tension roller 2B opposite the secondary transfer roller 15 as illustrated in FIGS. 4 and 6. The repulsive force from the back tension roller 2B is prevented from acting on the toner in the test images, thereby preventing the toner from scattering. Furthermore, because the test images are formed outside the image foaming area PA, the test images can be formed at any time during continuous sheet conveyance, as compared with forming the test images only at a time between successive recording media sheets as in the related-art transfer device. This means that a dedicated control system for opening and closing the shield member to block the electrical field is not necessary so that toner scattering can be prevented with a simple configuration.

Figure 7:
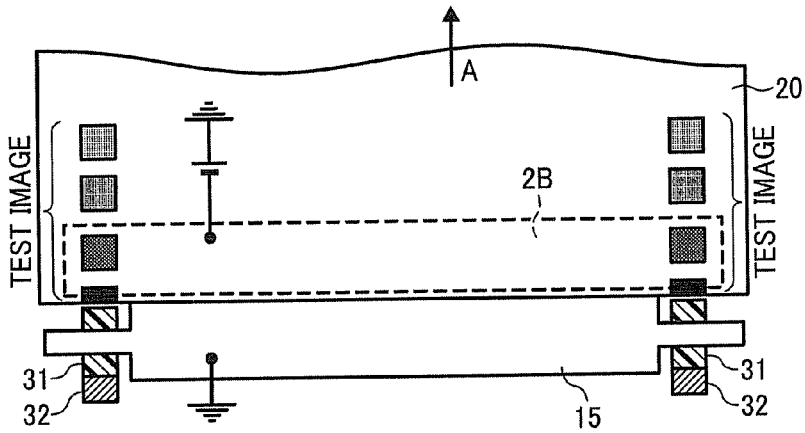
FIG. 7 is a plan view illustrating the transfer device including the shield member according to a second illustrative embodiment of the present invention.

Next, with reference to FIG. 7, a description is provided of prevention of toner scattering according to a second illustrative embodiment. FIG. 7 is a plan view schematically illustrating the secondary transfer roller 15, the transfer belt 20, the test images thereon, and a shield member 31, according to the second illustrative embodiment.

In the second illustrative embodiment illustrated in FIG. 7, the shield member 31 is provided to the secondary transfer roller side. More specifically, the shield member 31 is disposed substantially at each end of a shaft of the secondary transfer roller 15 in the axial direction, outside the image forming area PA of the transfer belt 20. The shield member 31 has a cylindrical shape fitted onto the shaft of the secondary transfer roller 15. The shield member 31 is made of electrostatically insulating, non-conductive resin having a width sufficient to cover the test images in the axial direction.

Substantially the end portion of the secondary transfer roller 15 in the axial direction is close to the edge of the image forming area PA on the secondary transfer belt 20. Thus, the shield member 31 can block the electrical field at a place having the greatest potential gradient at the edge portion of the secondary transfer roller 15.

The shield member 31 disposed at each end of the secondary transfer roller 15 does not interfere with conveyance of the recording medium P even when the recording medium P having a width equal to or greater than the secondary transfer roller 15 in the axial direction thereof and equal to or less than the size of the back tension roller 2B in the axial direction is subjected to the transfer process.

Figure 8A:
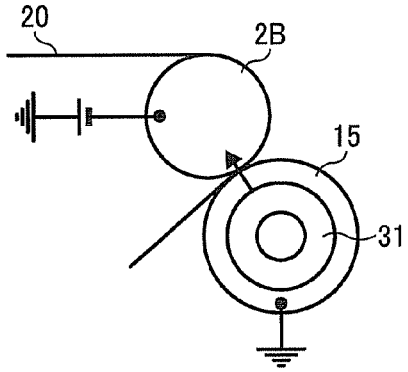
FIGS. 8A and 8B are side views schematically illustrating a back tension roller, a secondary transfer roller, a transfer belt, and the shield member provided to the secondary transfer roller side.
Figure 8B:
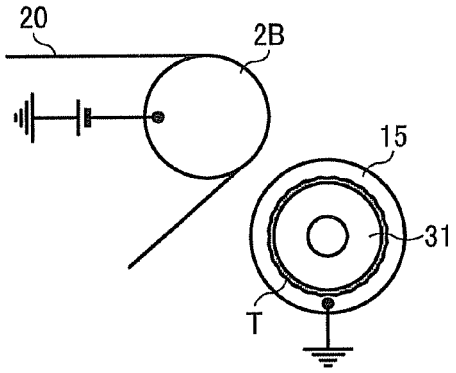

In a case in which the shield member 31 is disposed at the secondary transfer roller side, the charge bias indicated by an arrow in FIG. 8A is blocked. However, flow of air generated by the moving transfer belt 20 may cause the toner in the image other than the test images to scatter. When this happens, as illustrated in FIG. 8B, scattered toner T may stick to the surface of the shield member 31 which is exposed outside. FIG. 8A is a side view schematically illustrating the transfer belt 20, the secondary transfer roller 15, and the shield member 31 disposed at the secondary transfer roller side. In FIG.

8A, the arrow indicates the direction of the charge bias. FIG. 8B is a side view schematically illustrating the transfer belt 20, the secondary transfer roller 15, and the shield member 31 to which toner T is adhered.

When paper jams occur or any other occasions where the inside of the secondary transfer device 9 needs to be accessed, the shield member 31 contaminated with toner not only gives an impression that the device is contaminated, but also a hand of a user or a maintenance operator trying to fix the problem may be contaminated with toner. In view of the above, as illustrated in FIG. 8B, a cleaning device 32 is provided contactably relative to the shield member 31.

Figure 9A:
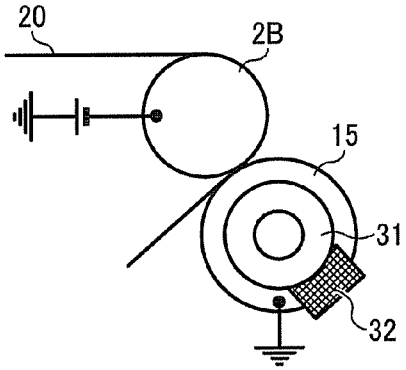
FIGS. 9A and 9B are side views schematically illustrating the back tension roller, the secondary transfer roller, the transfer belt, the shield member, and a cleaning mechanism for the shield member.
Figure 9B:
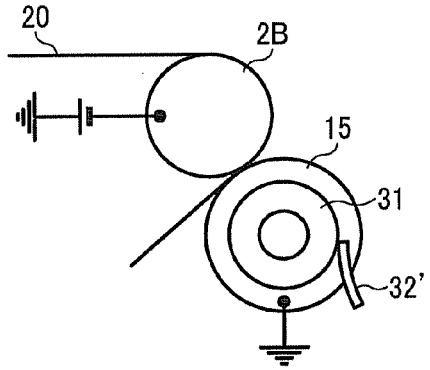

With reference to FIGS. 9A and 9B, a description is provided of the cleaning device 32. FIG. 9A is a side view schematically illustrating the shield member 31 and the cleaning device 32 according to an illustrative embodiment. FIG. 9B is a side view schematically illustrating a cleaning device 32' as a variation of the cleaning device 32.

As illustrated in FIG. 9A, the cleaning device 32 may be made of a resilient member including, but not limited to a brush having flexible bristles, a sponge, and an elastic member such as Moltprene (registered trademark).

FIG. 9B illustrates a variation of the cleaning device 32. The cleaning device 32' is a blade member made of resilient, flexible member such as Mylar (registered trademark). The cleaning device 32' employs a so-called "counter blade system" and contacts the surface of the shield member 31 at a predetermined angle to scrape the toner adhered to the shield member 31. The material for the cleaning device is not limited to the material described above. As long as the material has the mechanical characteristics described above and is formed easily into a shape that can remove the toner with ease while having good releasability against the toner, any other suitable resin can be used.

With this configuration, the shield member 31 prevents toner from scattering while the cleaning device 32 (32') removes toner adhered to the shield member, thereby preventing contamination of the shield member 31 and peripheral devices, as well as a hand of those who access inside the secondary transfer device.

According to an aspect of this disclosure, the foregoing embodiments are employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

an image bearing member to bear a toner image on a surface thereof within a predetermined image forming area;

a transfer member disposed opposite the image bearing member, to form a transfer nip between the transfer member and the image bearing member through which the recording medium is conveyed and to transfer the toner image from the image bearing member onto the recording medium in the transfer nip;

a test image detector disposed downstream from the transfer nip in the direction of conveyance of the recording medium to detect a density of a test image for adjustment of toner density formed outside the image forming area of the image bearing member; and a shield member disposed between the test image and the transfer member to shield the test image from an electrical field generated between the image bearing member and the transfer member, wherein the transfer member includes a roller having a roller shaft, and the shield member is disposed at opposed ends of the roller shaft in an area corresponding to an area outside the image forming area.

2. The transfer device according to claim 1, wherein the shield member is made of an electrically non-conductive material.

3. The transfer device according to claim 1, wherein the shield member has a cylindrical shape and is rotatably fitted onto each end of the roller shaft of the roller in the axial direction thereof.

4. The transfer device according to claim 3, further comprising a cleaning device to contact the outer surface of the shield member to remove toner adhered thereto.

5. The transfer device according to claim 4, wherein the cleaning device is pressed against the shield member to slidably contact the surface of the shield member.

6. The transfer device according to claim 4, wherein the cleaning device is made of resilient material.

7. The transfer device according to claim 6, wherein the cleaning device comprises one of a brush and a sponge.

8. The transfer device according to claim 4, wherein the cleaning device comprises a blade, the leading edge of which contacts the surface of the shield member at a predetermined angle.

9. An image forming apparatus, comprising:

an image bearing member to bear a toner image on a surface thereof within a predetermined image forming area; and a transfer device to transfer the toner image on the image bearing member to a recording medium, the transfer device including:

a transfer member disposed opposite the image bearing member, to form a transfer nip between the transfer member and the image bearing member through which the recording medium is conveyed and to transfer the toner image from the image bearing member onto the recording medium in the transfer nip;

a test image detector disposed downstream from the transfer nip in the direction of conveyance of the recording medium to detect a density of a test image for adjustment of the density of the toner image formed outside the image forming area of the image bearing member; and a shield member disposed between the test image and the transfer member to shield the test image from an electrical field generated between the image bearing member and the transfer member, wherein the transfer member includes a roller having a roller shaft, and the shield member is disposed at opposed end of the roller shaft in an area corresponding to an area outside the image forming area.

10. The image forming apparatus according to claim 9, further comprising:

a photoconductive drum to bear a latent image on a surface thereof; and a developing device to develop the latent image on the photoconductive drum with toner to form the toner image, wherein the image bearing member is an intermediate transfer member onto which the toner image formed on the photoconductive drum is transferred.

11. An image forming apparatus, comprising:

an image bearer to bear a toner image on a surface thereof within a first area and a second area;

a transfer roller including a roller part and a roller shaft, the roller part forming a transfer nip between the roller part and the first area of the image bearer, through which the recording medium is conveyed to transfer the toner image formed within the first area of the image bearer from the image bearer onto the recording medium;

a detector to detect the toner image borne within the second area of the image bearer; and a shield member made of an electrically non-conductive material and disposed at the roller shaft in an area opposed to the second area of the image bearer.

12. The image forming apparatus according to claim 11, wherein the shield member has a cylindrical shape and is rotatably fitted onto the roller shaft of the transfer roller in the axial direction thereof.

13. The image forming apparatus according to claim 12, further comprising a cleaning device that contacts an outer surface of the shield member to remove toner adhered thereto.

14. The image forming apparatus according to claim 12, wherein a diameter of the shield member is smaller than a diameter of the roller part of the transfer roller.

15. The image forming apparatus according to claim 11, wherein the shield member is made of an insulating resin.

16. The image forming apparatus according to claim 11, wherein the image bearer has a belt shape formed into a loop and wound around a plurality of rollers.

17. The image forming apparatus according to claim 16, further comprising:

a photoconductive drum to bear a latent image on a surface thereof; and a developing device to develop the latent image on the photoconductive drum with toner to form the toner image, wherein the image bearer is an intermediate transfer belt onto which the toner image formed on the photoconductive drum is transferred.

* * * * *